US007178191B2

(12) United States Patent
Hitzler

(10) Patent No.: US 7,178,191 B2
(45) Date of Patent: Feb. 20, 2007

(54) PAINT BRUSH WITH ANGLE ADJUSTABLE HANDLE

(76) Inventor: Jeffrey Davis Hitzler, 1066 Saint Paul St., Green Bay, WI (US) 54304

( * ) Notice: Subject to any disclaimer, the term of this patent is extended or adjusted under 35 U.S.C. 154(b) by 361 days.

(21) Appl. No.: 10/754,116

(22) Filed: Jan. 9, 2004

(65) Prior Publication Data

US 2004/0187242 A1 Sep. 30, 2004

Related U.S. Application Data

(60) Provisional application No. 60/439,605, filed on Jan. 14, 2003.

(51) Int. Cl.
*A46B 5/00* (2006.01)
*A46B 7/00* (2006.01)

(52) U.S. Cl. ..... 15/172; 15/144.1; 15/144.2

(58) Field of Classification Search ..... 15/143.1, 15/144.1, 145–146, 159.1, 160, 171–172, 15/176.1, 176.6; 16/425, 900; 24/456; 294/167, 294/58

See application file for complete search history.

(56) References Cited

U.S. PATENT DOCUMENTS 519,515 A * 5/1894 Walsh ..... 294/58
1,595,901 A * 8/1926 Mahler ..... 15/144.1
1,787,970 A * 1/1931 Bertola ..... 15/144.2
2,032,664 A * 3/1936 Raptis ..... 15/172
2,792,581 A * 5/1957 Woyton ..... 15/144.1
3,928,886 A 12/1975 Marino et al.
5,355,553 A 10/1994 Mahoney
5,502,859 A * 4/1996 Kim ..... 15/144.1
5,692,260 A * 12/1997 Haiduk ..... 15/167.1
6,119,311 A 9/2000 Lavallee
6,473,929 B1 11/2002 Learned
2002/0066151 A1 6/2002 Parker et al.

* cited by examiner

*Primary Examiner*—Gladys J P Corcoran
*Assistant Examiner*—Laura C Guidotti
(74) *Attorney, Agent, or Firm*—Brannen Law Office, LLC

(57) ABSTRACT

A means by which to adjust the angle of a handle. The device is comprised of two components. The body, made of a semi rigid material having a shape that is capable of being inserted into a typical paint brush ferrule. From this section, a "U" shaped component having a cylindrical cross section, and having a width of the attaching section. The handle of this design is composed of a suitable material having a varying thickness along its length. The handle having a section that partially encircles the "U" shaped component. The handle component has a hook at one end of one of the legs that receives the end of the other leg. This locks the handle in place on the "U" shaped component. When unlocked, the handle is capable of being moved along the length of the "U" shape to achieve the desired angle.

9 Claims, 4 Drawing Sheets

PAINT BRUSH WITH ANGLE ADJUSTABLE HANDLE

CROSS REFERENCE TO RELATED APPLICATION

This application is related to Provisional Application for U.S. patent, application Ser. No. 60/439,605, filed Jan. 14, 2003.

FIELD OF THE INVENTION

The present invention relates to paint brushes and, more specifically to a paint brush that adjusts its angles to facilitate painting difficult and hard to reach surfaces.

BACKGROUND OF THE INVENTION

The basic design of paint brushes has gone unchanged. Paint brushes typically include a plurality of bristles which are bunched together by a collar into a bristle head and attached to a rigid handle having an axis parallel to the bristles. For years the need to change the angle of a paint brush handle has been recognized. The ability to reach places or orientations not capable with a typical paint brush and handle.

The user has had to accept the capabilities of the typical handle as is. Additionally, users have cut the handle shorter to allow for better usage. New designs that are equipped with short handles address one issue only. Prior art shows attempts at creating an adjustable angle handle.

Prior art adjustable angle handle brushes were complicated in design and more difficult to manufacture. They were composed of multiple components that required sophisticated manufacturing abilities. The increase in complexity creates a product that is too expensive to market, and more difficult for the consumer to operate.

SUMMARY OF THE INVENTION

In accordance with the present invention, there is provided a means by which to adjust the angle of a handle that is easy to use. A brush comprising a body having a first and second ends. A bristle head disposed at the first end of the body, and an angle adjustable handle at the second end of the body disclosed. The handle is adapted to permit the bristle head of the brush to be positioned at angles relative to that of the handle. The body is composed of a "U" shaped component with a first end suitably shaped to be positioned within a typical ferrule. The "U" shaped component having a width equal to that of the width of the ferrule. The handle component having a first and second end. The first end is such that the diameter is sufficiently adequate to allow for movement along the "U" shaped component when the handle is unlocked. The diameter is such that to allow for sufficient clamping force upon the "U" shaped component as not to allow slippage when the handle is locked.

It is therefore an object of the invention to provide a device for the application of paints, stains, and other coatings.

It is another object of the invention to provide a paint brush handle that has angle adjustability.

It is another object of the invention to provide for a paint brush with a removable handle.

It is another object of the invention to provide a solution to the deficiencies of previously invented brushes by making it easier to paint.

It is another object of the invention to provide paint brushes wherein the painter can paint surfaces that ordinarily cannot be painted due to unusual angles or directions of brush strokes that would be required.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE INVENTION

Figure 1:
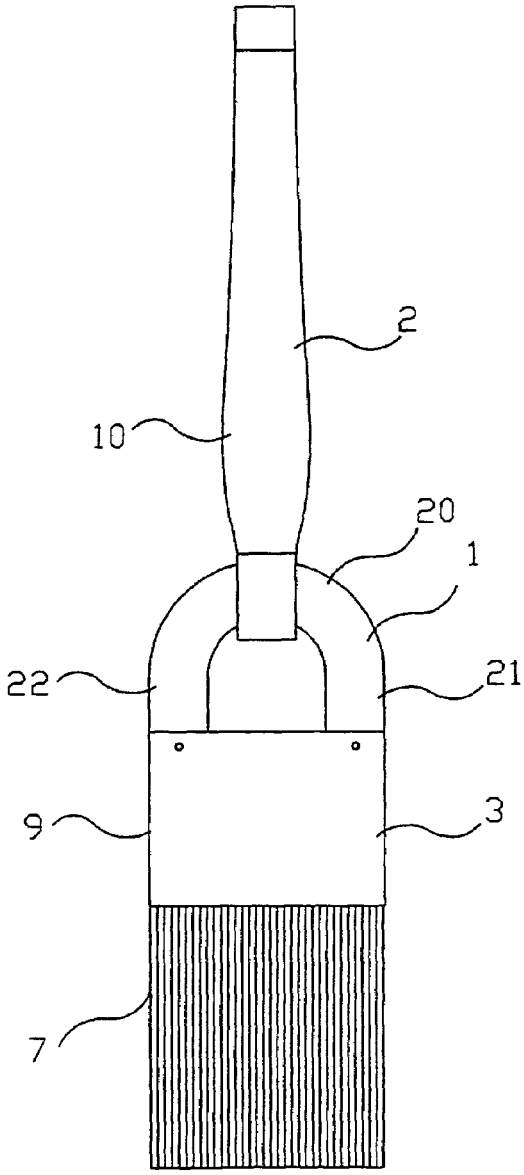
FIG. 1 is a front view of a paint brush according to the present invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Reference is now made to the drawings wherein the present invention is illustrated and wherein in similar components bear the reference numeral throughout the several views.

In FIG. 1, a paint brush is depicted comprising a brush section 9 and a handle section 10. Brush section 9 comprises a plurality of bristles 7, which may be either artificial or natural, and a metal ferrule 3 to contain the bristles. Handle section 10 has end 8 partially encircling "U" shaped component 1 affixed to the brush. The other end comprises two legs 12 and 13. One leg 13 has an end 25 with a hook 5 integrally formed into it. Leg 12 has an end 4 with no hook and terminates at a point that is long enough for it to be securely fastened into the hook 5 of leg 13.

Figure 6:
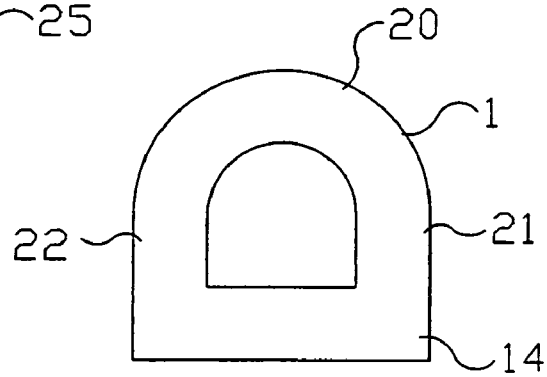
FIG. 6 is a front view of the "U" shaped component of the paint brush in FIG. 1.
Figure 7:
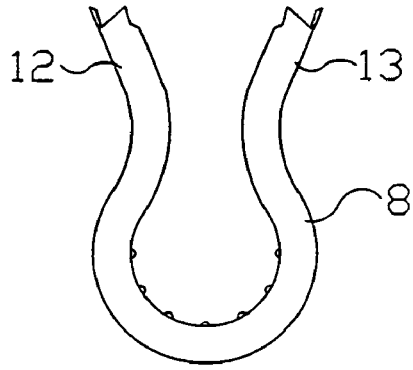
FIG. 7 is an enlarged front view of the encircling section of the handle component.

The "U" shaped component 1 being composed of a suitable plastic material and having parallel sides 21 and 22 and an arc 20 having a diameter equal to the width of a rigidly attached body 14. The arc 20 of component 1 being cylindrical in configuration with a diameter equal to the depth of the body 14 as depicted in FIG. 6. The body section 14 having a shape suitable to securely fit into a typical paint brush ferrule 3.

Figure 2:
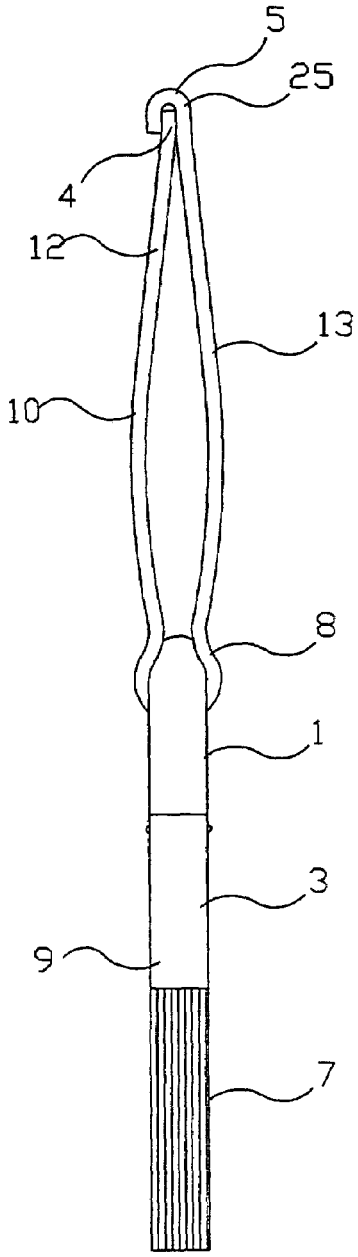
FIG. 2 is a side view of FIG. 1 paint brush according to the present invention.
Figure 5:
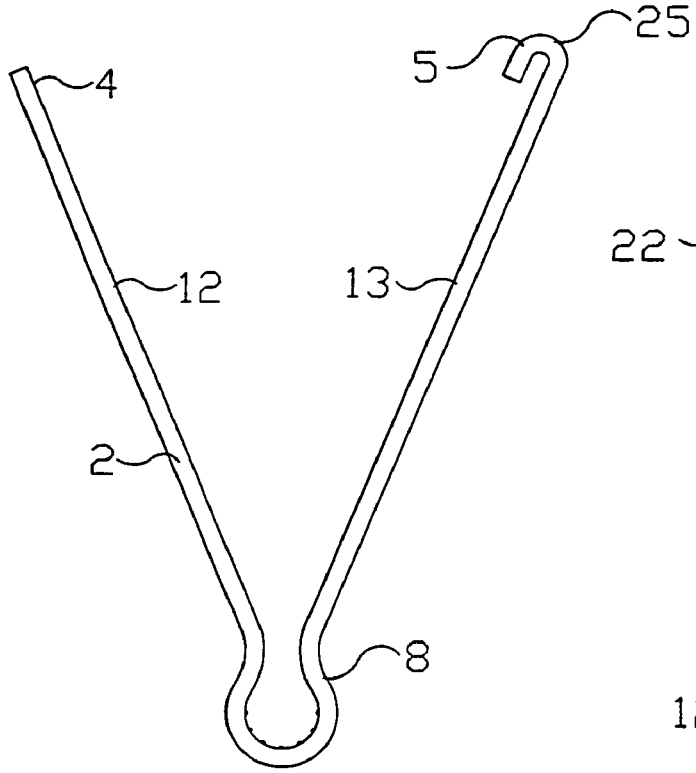
FIG. 5 is a side view of the handle component of the paint brush in FIG. 1 in the unlocked position.

The handle portion 2 of section 10 being composed of a suitable plastic material and having an overall length sufficient to create a comfortable handle to hold the component. The profile of the handle portion 2 is similar to that of a conventional paint brush as shown in FIG. 1. Handle portion 2 is comprised of two connected legs 12 and 13. The length of the legs are nearly equal. When in the unlocked position as depicted in FIG. 5 the legs 12 and 13 create a "V" shape. The angle of the "V" is to be sufficient, based upon material characteristics, to create sufficient clamping force on the "U" shaped component 1 when the legs 12 and 13 are locked together. To lock the legs 12 and 13 together in order to clamp the handle portion onto "U" shape component 1 the ends 4 and 25 are brought together. Leg 12 with the straight end 4 is then slid into the hook 5 of end 25 on leg 13 as depicted in FIG. 2. At the section where the legs 12 and 13 converge is a semicircular section 8. The inside diameter of section 8 is slightly more than the outside diameter of component 1 when the handle portion 2 is unlocked. When handle portion 2 is locked, the inside diameter of section 8 is slightly less than the outside diameter of component 1. Rigidly attached to the inside face of semicircular section 8 are a series of protrusions. The protrusions having a configuration sufficient in size and amount to add additional gripping force upon component 1 when the handle portion 2 is locked.

Figure 3:
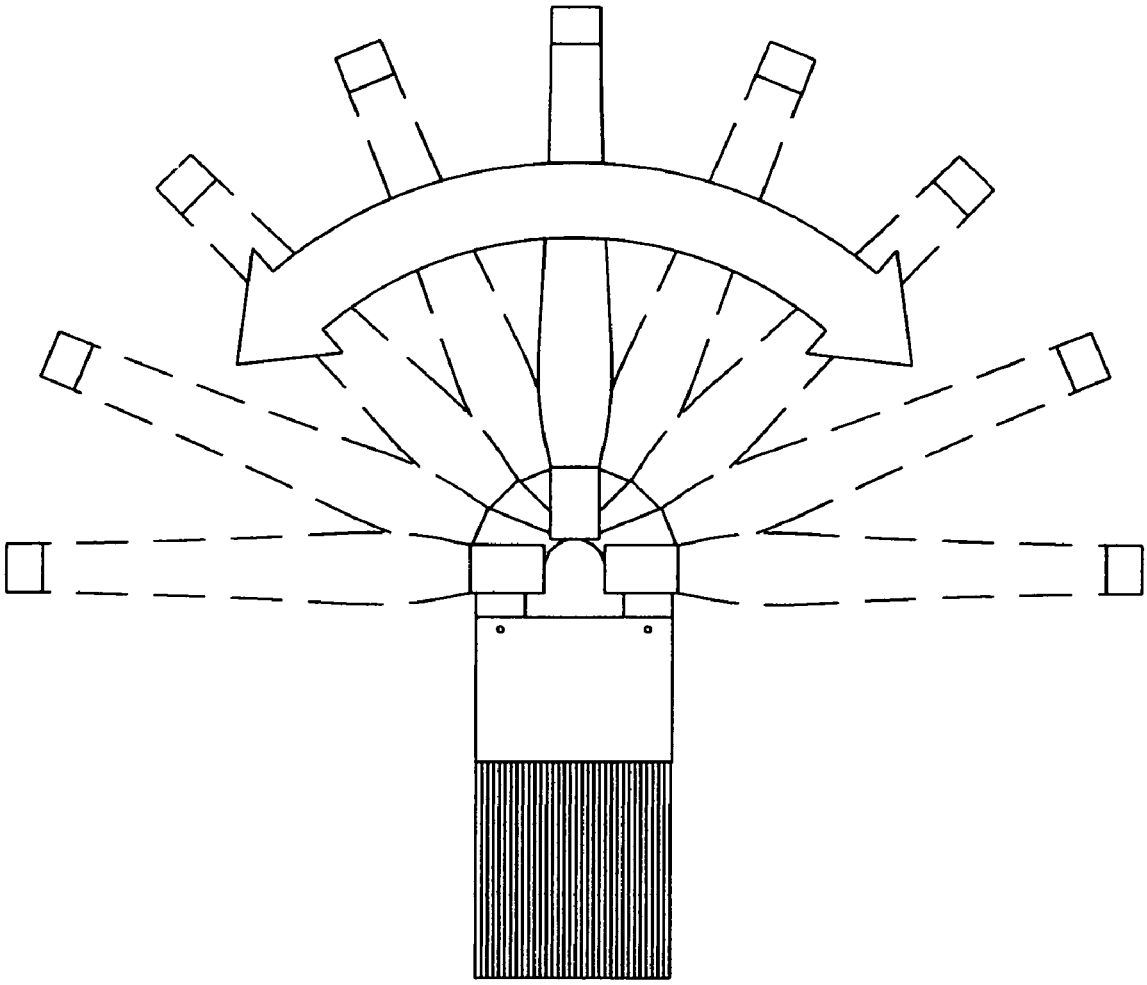
FIG. 3 is a front view of the paint brush according to the present invention showing the adjusting movement of the handle orientation, up to 180 degrees.
Figure 4:
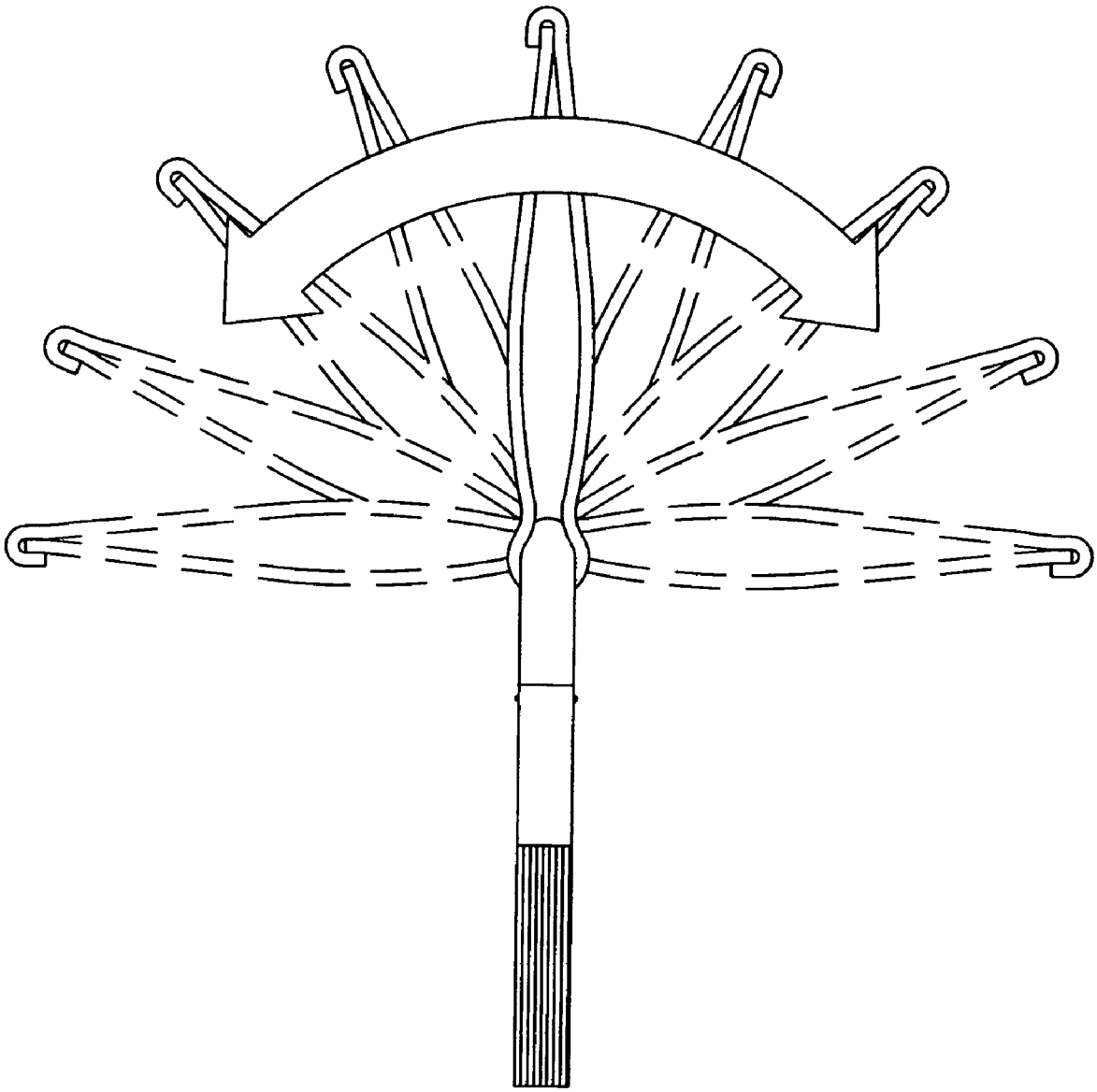
FIG. 4 is a side view of the paint brush according to the present invention, showing the adjusting movement of the handle orientation, up to 180 degrees.

To adjust handle portion 2 to a differing angle along the "U" shape of component 1 the handle portion 2 is unlocked by unhooking ends 4 and 25. This releases the clamping force upon component 1. Handle portion 2 is then free to be moved to a desired angle as depicted in FIG. 3 and FIG. 4 and then locked in place by hooking ends 4 and 25 together.

What is claim is:

1. A paint brush with an angle adjustable handle for increased functionality and ease, comprising:

a paint brush section having bristles and a U-shaped component extending from the paint brush section;

a handle having first and second ends, said first end is an encircling end that clamps around the U-shaped component, said second end opposite the first encircling end having a hook and an end piece that lock together such that the handle is locked to the U-shaped component of the paint brush section, said first encircling end including protrusions that add a clamping force to the handle.

2. A paint brush comprising:

a brush section comprising bristles and a component, said component comprising an arc; and a handle section comprising a first end and a second end, said first end of said handle section clamps around and onto said component of said brush, said handle section further comprising a first leg and a second leg that lock together in a locked position, and have a V-shape when in an unlocked position, wherein said handle section clamps onto said component in a selected angular orientation.

3. The paint brush of claim 2 wherein said handle section first end comprises a semicircular section that partially encircles said component to clamp around said component.

4. The paint brush of claim 2 wherein said component is a U-shaped component comprising an arc, a first side and a second side, said second side being parallel to said first side.

5. The paint brush of claim 4 wherein said handle section clamps around one of said arc, said first side of said component, and said second side of said component.

6. A paint brush comprising:

a brush section having bristles and a U-shaped component; and a handle section having a first end and a second end, said first end being lockably connectable to said U-shaped component, said handle section further comprising:

a first leg with a first end and a second end; and a second leg with a first end and a second end; and wherein said handle section is selectably and lockably oriented in a desired angular position with respect to said brush section, and wherein said first end of said first leg and said first end of said second leg form a semicircular end of said handle section that encircles said U-shaped component in a desired location and orientation.

7. The paint brush of claim 6 wherein said second leg second end comprises a hook for receiving said first leg second end to lock said handle section.

8. The paint brush of claim 6 wherein said semicircular end of said handle section further comprises protrusions.

9. The paint brush of claim 6 wherein said U-shaped component comprises an arc, a first side and a second side.

* * * * *